US006165331A

United States Patent [19]

Hughes

[11] Patent Number: 6,165,331

[45] Date of Patent: Dec. 26, 2000

[54] ELECTROLYSERS

[75] Inventor: David A. Hughes, Frodsham, United Kingdom

[73] Assignee: Cumberland Electrochemical Limited, Merseyside, United Kingdom

[21] Appl. No.: 09/415,775

[22] Filed: Oct. 8, 1999

[30] Foreign Application Priority Data

Oct. 10, 1998 [GB] United Kingdom ..... 9822048
May 4, 1999 [GB] United Kingdom ..... 9910075

[51] Int. Cl.[7] ..... C25B 9/00

[52] U.S. Cl. ..... 204/254; 204/256; 204/268; 204/270; 204/280; 205/556; 205/620; 205/622

[58] Field of Search ..... 205/556, 620, 205/622; 204/254, 256, 268, 270, 280

[56] References Cited

U.S. PATENT DOCUMENTS

| | | | |
|---|---|---|---|
| 3,990,957 | 11/1976 | Hoekje et al. | 205/620 |
| 4,138,324 | 2/1979 | Meyer | 204/284 |
| 4,188,464 | 2/1980 | Adams et al. | 429/210 |
| 4,269,688 | 5/1981 | DuBois | 204/254 |
| 4,279,712 | 7/1981 | Satoh et al. | 205/620 |
| 4,280,883 | 7/1981 | Raetzsch | 204/256 |
| 4,339,323 | 7/1982 | Dilmore et al. | 204/256 |
| 4,530,742 | 7/1985 | Carlin et al. | 204/268 |
| 4,560,452 | 12/1985 | Morris et al. | 204/254 |
| 4,604,171 | 8/1986 | Morris et al. | 204/254 |
| 4,671,351 | 6/1987 | Rappe | 165/133 |
| 5,114,547 | 5/1992 | Ullman | 204/252 |
| 6,027,620 | 2/2000 | Jackson et al. | 204/254 |

FOREIGN PATENT DOCUMENTS 1443656 5/1974 United Kingdom .

OTHER PUBLICATIONS

Search Report in related British Patent Application GB9910075.2, issued Jul. 26, 1999, 2p.

*Primary Examiner*—Bruce F. Bell
*Attorney, Agent, or Firm*—Sheldon & Mak; David A. Farah

[57] ABSTRACT

A bipolar metal electrode for the electrolysis of hydrochloric acid, comprising a nickel alloy cathode plate and a titanium anode mesh coupled together by a hydrogen barrier, where the hydrogen barrier is an aluminum plate, where the titanium anode mesh is connected to a titanium backplate by a plurality of titanium supports and where the titanium backplate is spaced apart from the nickel alloy cathode plate by the aluminum plate. An electrolyser comprising one or more bipolar electrodes according to present invention. A method of producing chlorine from hydrochloric acid comprising providing one or more bipolar metal electrodes according to the present invention or an electrolyser according to the present invention, and contacting the one or more bipolar electrodes or the electrolyser with hydrochloric acid.

15 Claims, 2 Drawing Sheets

ELECTROLYSERS

CROSS-REFERENCE TO RELATED APPLICATIONS

The present Application takes priority from United Kingdom patent application 9822048.6, titled "Electrolysers" and filed Oct. 10, 1998; and takes priority from United Kingdom patent application 9910075.2, titled "Electrolysers" and filed May 4, 1999, the contents of which are incorporated in this disclosure by reference in their entirety.

FIELD OF THE INVENTION

The present invention relates to electrolysers, particularly with electrolysers of the type comprising an assembly of electrolytic cells in a bipolar configuration for the electrolysis of hydrochloric acid.

BACKGROUND

In accordance with conventional practice in the electrolyser art, electrolytic cells may be connected in series in a common housing, with the anodes of one cell being electrically in series with the cathodes of the prior cell and mounted on the opposite sides of a common structural member. In this way, the cathodes of one cell are in series with the anodes of the next adjacent cell in the electrolyser and mounted on a common structural member, and the anodes of the cell are in series with the cathodes of the prior cell in the electrolyser. Such a configuration is called a bipolar configuration.

An electrolyser is an assembly of electrolytic cells in a bipolar configuration. The common structural member is called a bipolar unit or bipolar electrode. This includes the backplate, the anodes of one cell in the electrolyser and the cathodes of the next adjacent cell. The electrolytic cell provided by the anode of one bipolar electrode, facing the cathodes of the adjacent bipolar electrode, so that electrolysis of the electrolyte may be carried out, is called a "bipolar cell".

Bipolar electrolysers provide economy of materials of construction and plant space. However, to take advantage of the apparent economies of bipolar electrolysers, it is necessary for current density to be as high as possible. When electrolysis is carried out at high current density, it is necessary that there is minimal electrical resistance between elements of the bipolar electrode. It is also important that seepage, of electrolyte, between elements of the bipole, is prevented.

Chlorine is produced in vast quantities by a variety of salt electrolysis processes. There are three principal processes operated; mercury cell; diaphragm cell and membrane cell. To a lesser extent, chlorine is also produced from electrolysis of hydrochloric acid although the technology has lagged behind electrolysis of salt solution.

In conventional electrolysis processes based on hydrochloric acid, the hydrochloric acid (typically 22 wt % HCl) is fed into the cells in two separate circuits, a catholyte and an anolyte circuit. During electrolysis the concentration is reduced to approximately 17%. The electrolyser is bipolar, with pairs of electrodes arranged like a filter press. A diaphragm separates the anode compartment from cathode to prevent mixing of the gaseous products. Both anode and cathode are graphite and the diaphragm is PVC fabric. Chlorine dissolved in the anolyte diffuses through the diaphragm and is reduced at the cathode causing a loss of 2–2.5% of the theoretical current yield. Hydrogen ions are also transmitted through the diaphragm under influence of the applied field and maintain the overall process in balance, as hydrogen ions are reduced at the cathode to hydrogen. Each electrolyser consists typically of 30–36 individual cells formed from vertical graphite plates connected in series and separated by a PVC diaphragm. This process is operated on a large scale as a convenient method of recycling chlorine in organic synthesis where hydrogen chloride is produced as a byproduct. It is believed that this equipment is unsuited to the relatively small scale requirements of the water industry.

The chlorination of potable water using gaseous chlorine was first experimentally employed in 1896 and is still the prime method of disinfection today. Since the early 1970's, due to the potential dangers of transporting and storing large volumes of gaseous chlorine, an alternative in situ method of generation have been developed. This process involves electrolytic conversion of salt solution to chlorine in solution as sodium hypochlorite. Although successfully adopted by many water authorities, there are a number of disadvantages including:

does not generate gaseous chlorine;

involves complex equipment to prepare brine solution;

pH control necessary;

complex chemistry involved;

includes dosing salt into water being disinfected; and]

only partial conversion of salt possible.

The major technological step forward in chlorine cell technology in the last 30 years has been the adoption of coated titanium electrodes (anodes). Prior to this discovery anodes were made of graphite and used exclusively for more than 60 years. Since 1970 all chlorine plants operating on saturated brine have been converted to titanium anodes. However, a similar adoption of titanium anodes has not occurred in hydrochloric acid electrolysis because of two main problems.

The first problem concerns the corrosivity of hydrochloric acid to titanium and the operational constraints of noble metal coatings at low pH values. For example, manufacturers of titanium normally state that titanium is only moderately resistant to hydrochloric acid, quoting a corrosion rate of 4.4 mm/year at 20% acid concentration (normal electrolysis concentration). Also, noble metal anode coatings are thought to wear more rapidly when the pH drops below 4.

The second problem concerns the anode of electrical connection. Industrial electrochemical cells can be connected in mono or bipolar configuration, but in hydrochloric acid, titanium is not viable as a cathode because of corrosion via titanium hydride formation. Also, it is not possible to join other metals to titanium by conventional welding methods because of the formation of brittle intermetallic compounds.

In early chlor-alkali bipolar electrolysers, flow of electricity through the bipolar structure was enhanced by providing metal to metal contact between the titanium anode and steel cathode, by explosive bonding. However, it was soon found that hydrogen generated on the steel cathode surface migrated through the steel towards the titanium. This resulted in the formation of titanium hydride at the interface between the steel and titanium.

In the simplest form of bipolar electrode, titanium is coated on one side only; the reverse uncoated side being the cathode. As in chlor-akali, sea water electrolysers suffer from similar problems but at neutral pH values, hydride formation is not as severe. In older designs utilising rotating bipolar titanium electrodes, the formation of titanium hydride on the cathode surface is relatively slow. The main problem is mechanical; because titanium hydride has a lower bulk density than titanium, the structure gradually deforms, as one side becomes less dense than the other. The life of such electrodes in sea water electrolysis is 40% of those that do not use the reverse side as a cathode.

The problems associated with, and the mechanism of formation of titanium hydride, have been studied extensively. Hydrogen is unique in its ability to penetrate many of the metals from its gaseous state. This penetrative ability is enhanced by ionization or dissociation into atomic form. In addition, metals can become more susceptible to hydrogen penetration by physical form or temperature range. Some metals are non-occluders. Others react to form salts (the alkali metals of Group 1 and 2). Others form gaseous products (arsine). The transition metals are inert or form hydrides via endothermic or exothermic reactions. Titanium is in the group of transition metals, with the largest capacity to absorb hydrogen. This group absorbs hydrogen accompanied by reaction without loss of metallic characteristics. However, the accompanying 15% volume increase, in the case of titanium, can cause mechanical deformation.

Titanium is widely used in hydrogen containing environments under conditions where hydrogen could be evolved on titanium and, consequently, its susceptibility has been widely studied. Generally, it is believed that under conditions of neutral pH, ambient temperature and low salinity (sea water composition), hydride formation is confined only to titanium surfaces.

As a result of the foregoing problems with titanium, such as hydride formation, the conventional wisdom in relation to hydrochloric acid electrolysis has therefore been that graphite is the only viable electrode material, although it has several disadvantages, including:

poor dimensional stability;

massive constriction necessary because of low mechanical strength;

high energy consumption;

complex design to accommodate variations in inter-electrode gap due to high wear rate;

chlorine contains hydrogen and carbon dioxide;

hydrogen contains chlorine; and difficult to manufacture a cell of filter press form.

Therefore, there is a need for practical bipolar titanium electrodes for the electrolysis of hydrochloric acid. Further, there is a need for an improved method of performing the electrolysis of hydrochloric acid.

SUMMARY

An object of the present invention is to enable the practical use of bipolar titanium electrodes for the electrolysis of hydrochloric acid.

In accordance with the present invention, there is provided a bipolar metal electrode for the electrolysis of hydrochloric acid comprising a nickel alloy cathode plate and an anode structure in the form of a titanium anode mesh, coupled together via an aluminum hydrogen barrier. Preferably, the titanium anode mesh is connected to a titanium backplate by means of a plurality of titanium supports, the titanium backplate being spaced from the nickel alloy cathode plate by an aluminum plate which provides said hydrogen barrier and also acts as a current distributer. Further preferably, the titanium backplate and the nickel alloy cathode plate are mechanically and electrically coupled by means of a first plurality of aluminum elements whose one ends abut the titanium backplate and whose other ends are joined to respective nickel alloy elements mechanically coupled to the nickel alloy cathode plate, and a second plurality of aluminum elements whose one ends abut the nickel alloy cathode plate and whose other ends are joined to respective titanium elements mechanically coupled to the titanium backplate, each of the individual aluminum elements of both said first and second pluralities of aluminum elements extending through respective through-holes in the aluminum feeder plate.

Advantageously, the joints between the first aluminum elements and the nickel alloy elements, and between the second aluminum elements and the titanium elements, are formed by ultrasonic bonding. Further, advantageously, the first and second aluminum elements are laminar discs and the nickel alloy and titanium elements are substantially button shaped, whereby annular portions of the aluminum current distributer plate are located and held between shoulders on the buttons and the titanium or nickel alloy plate mechanically coupled thereto. Preferably the mechanical couplings are affected by welding.

In an assembled electrolyser according to the present invention, the bipolar electrodes are disposed between outer anode and cathode electrodes. Preferably, the cathode electrode comprises a nickel alloy sheet and an aluminum sheet, with a plurality of aluminum elements extending through respective through-holes in the aluminum sheet and being bonded at their one sides to nickel alloy elements which are mechanically coupled to the latter nickel alloy sheet. Further, preferably, the anode electrode comprises an aluminum sheet and a titanium backplate, carrying on its one side a titanium mesh separated therefrom by titanium spacers, with a plurality of aluminum elements extending through respective through-holes in the aluminum sheet and being bonded at their one sides to titanium elements which are mechanically coupled to the latter titanium sheet.

Additionally preferably, the exposed surfaces of the anodic element of titanium are provided with a barrier coating to resist hydrochloric acid. Further preferably, the titanium mesh is provided with a metal oxide electrocatalytic coating for chlorine production from hydrochloric acid.

FIGURES

These and other features, aspects and advantages of the present invention will become better understood with regard to the following description, appended claims, and accompanying figures where:

DESCRIPTION

In one embodiment of the present invention, there is provided a bipolar titanium electrode which can be used for the electrolysis of hydrochloric acid. In another embodiment, there is provided an electrode cell stack which can be used for the electrolysis of hydrochloric acid. In yet another embodiment of the present invention, there is provided a method of performing the electrolysis of hydrochloric acid.

Figure 1:
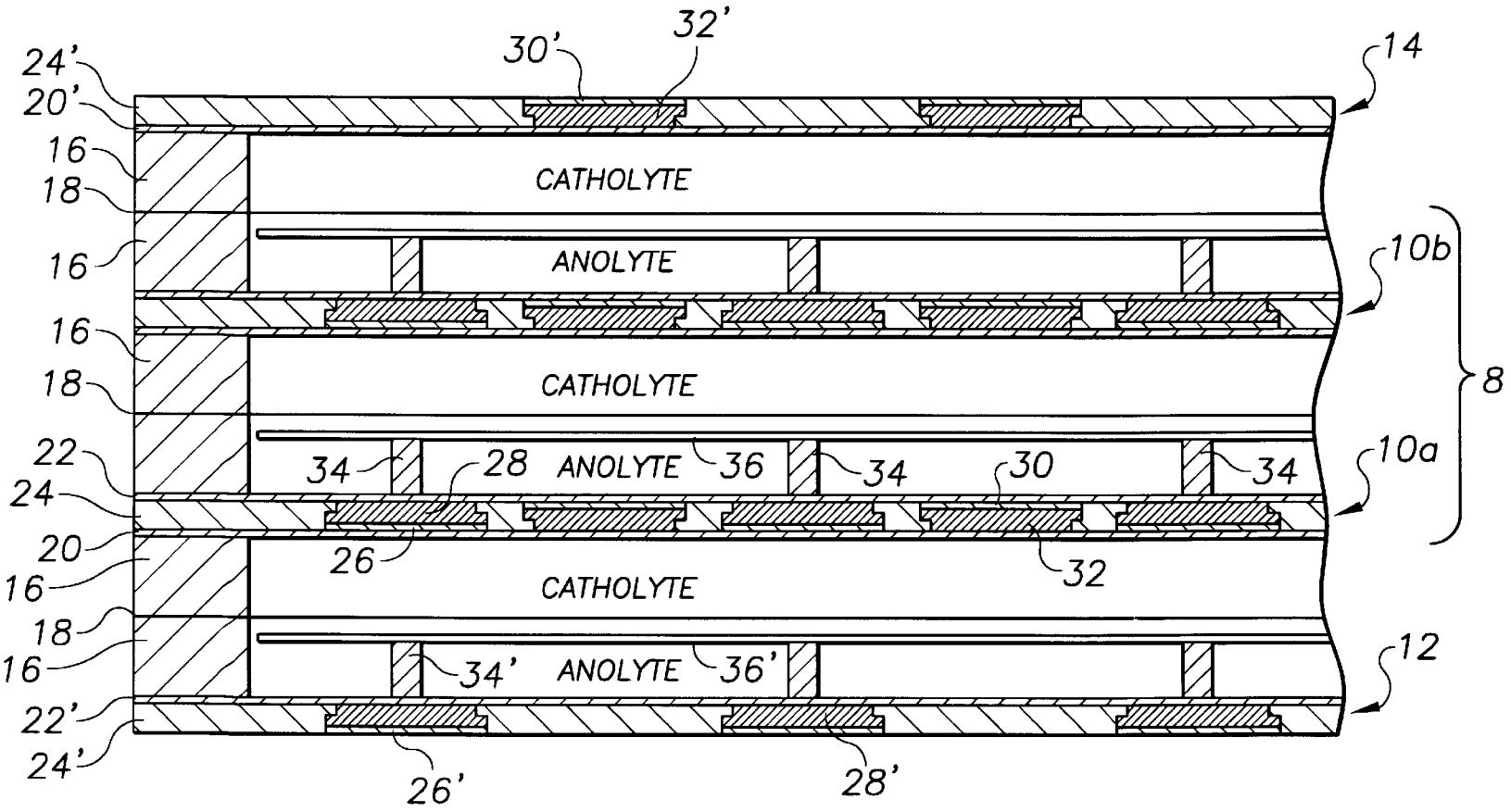
FIG. 1 is a horizontal section through part of an electrode cell stack according to the present invention.

Referring now to FIG. 1, there is shown a horizontal section through part of an electrode cell stack 8 according to one embodiment of the present invention which comprises a plurality (two in this case) of bipolar electrodes 10*a*, 10*b* disposed between an anode structure 12 and a cathode structure 14, the various electrodes 10, 12, 14 being held in parallel, mutually spaced apart relationship by PVDF elements 16 to form the cell stack 8. Adjacent electrodes are also separated by respective cation exchange membranes 18 made, for example, of NAFION® (E.I. Du Pont De Nemours and Company, Wilmington, Del., US) or FLEMION® (Asahi Glass company, Ltd., Tokyo, Japan).

Each bipolar electrode 10*a*, 10*b*, comprises a cathode plate 20 made of a nickel-based alloy, such as HASTELLOY® (Haynes Stellite Company, Kokomo, Ind., US), a titanium backplate 22 and an intermediate plate 24 of aluminum serving as a hydrogen barrier and also as a current feeder. Electrical connection between the titanium backplate 22 and the HASTELLOY® plate 20 is achieved by means of a plurality of first aluminum current distribution discs 26 whose one ends abut the HASTELLOY® plate 20 and whose other ends are connected by ultra-sonic bonding to respective titanium "buttons" 28 welded to the titanium backplate 22, and a plurality of second aluminum current distribution discs 30 whose one ends abut the titanium backplate 22 and whose other ends are connected by ultrasonic bonding to respective HASTELLOY® "buttons" 32 welded to the HASTELLOY® plate 20. The welds can, for example, be achieved by spot welding.

The aluminum discs 26 and 30 and the HASTELLOY® and titanium buttons 28, 32 are in respective circular sectioned apertures formed in the aluminum current distribution plate 24. Spaced from the titanium backplate 22 by a uniform distance using titanium spacers 34 fusion welded to the backplate 22 is a titanium mesh anode 36 which enables gas bubbles to disengage rapidly and not agglomerate on the surface.

Figure 4:
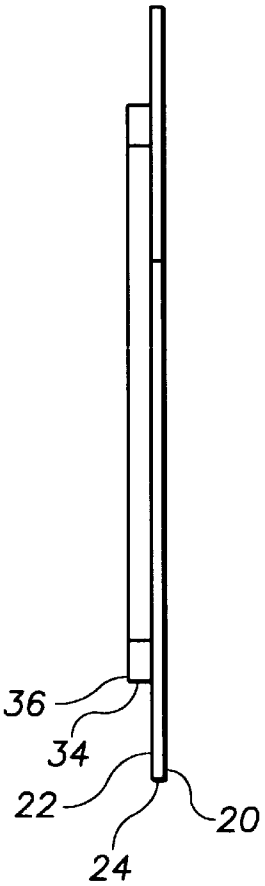
FIGS. 3 and 4 are plan and end views, respectively, of the electrode shown in FIG. 1.
Figure 2:
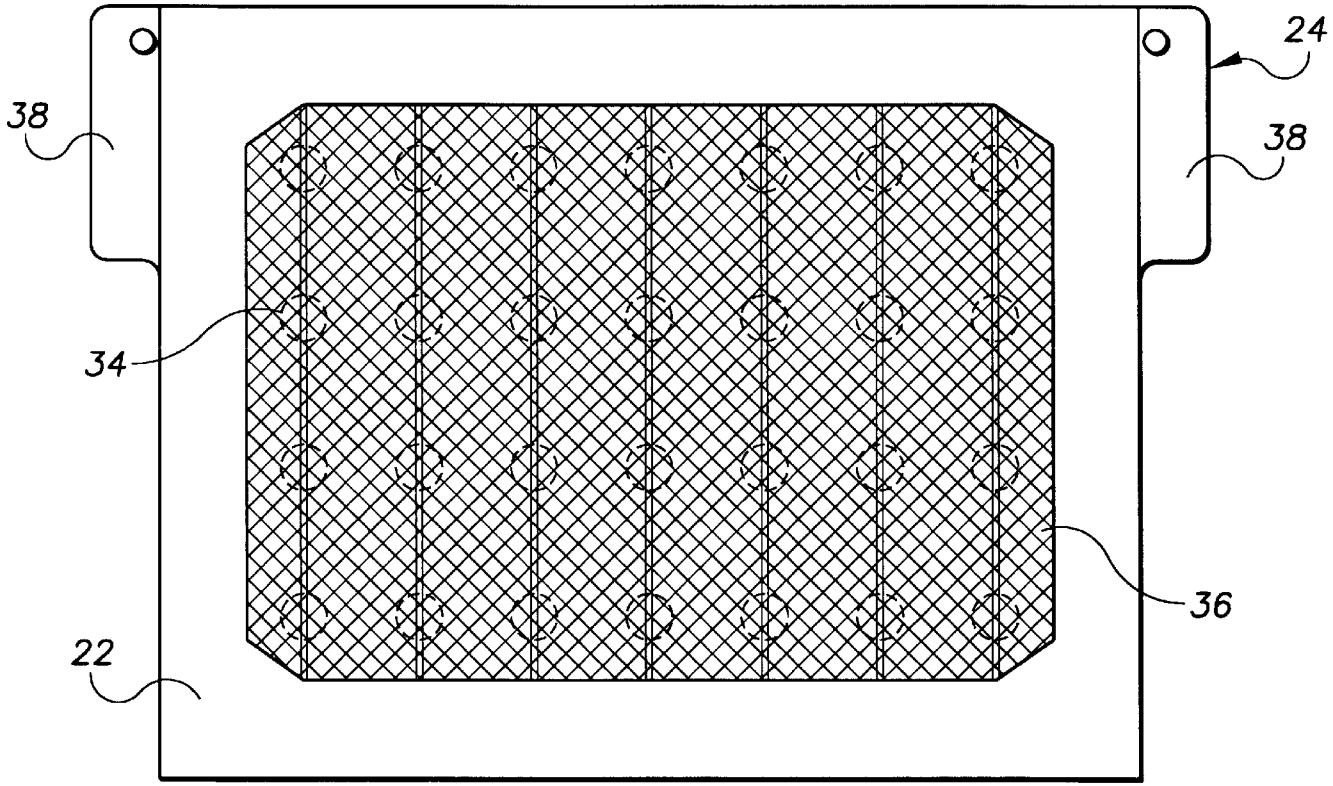
FIG. 2 is a front view of one bipolar electrode of the cell stack shown in FIG. 1.
Figure 3:
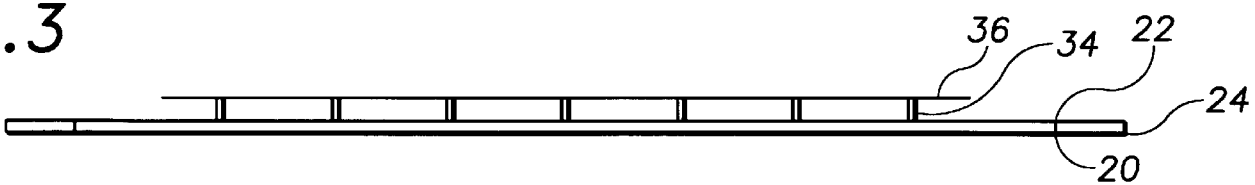

Referring now to FIGS. 2–4, there are shown a front view, plan view and end view, respectively, of one bipolar electrode of the cell stack shown in FIG. 1. As best seen in FIG. 2, the titanium mesh 36 is generally rectangular and is coupled to the titanium backplate 22 by an array of the titanium spacers 34 disposed in mutually orthogonal rows and columns. Also as seen in FIG. 2, the aluminum current distribution plate 24 is generally rectangular with side legs 38 at its two upper sides for mounting in the cell stack support structure (not shown).

At least the exposed surfaces of the anodic titanium backplate 22, and the pillars 34 are provided with a coating to resist corrosion by hydrochloric acid. In a preferred embodiment, the coating is a mixture of iridium and tantalum oxides in molar ratio mixtures from about 5:95 to about 95:5.

The surfaces of the titanium mesh 36 are provided with an electrocatalytic coating of high efficiency and long life for chlorine production from hydrochloric acid. For example, such a coating can be of a mixture of iridium, ruthenium and titanium oxides. In a preferred embodiment, the ratio is approximately 15:15:70 w/w.

The anode structure 12 at the bottom of FIG. 1 is constructed so as to be the same as the bipolar electrodes 10*a*, 10*b* except that it omits the HASTELLOY® plate 20 and the "second" aluminum discs 30 and HASTELLOY® buttons 32.

The cathode structure 14 at the top of FIG. 1, on the other hand, is constructed so as to be the same as the bipolar electrodes 10*a*, 10*b* except that it omits the titanium backplate 22, the titanium mesh 36 and the "first" aluminum discs 26 and titanium buttons 28.

In use, the spaces between the electrodes are arranged to be fed with hydrochloric acid. Passage of current through the cells establishes anolyte and catholyte regions as shown in FIG. 1 in accordance with well known principles, to produce chlorine gas.

As explained above, in a preferred embodiment, ultrasonic bonding is used to join together the dissimilar metals. As with most techniques for joining dissimilar metals, there are practical limitations as to what can be done. The present invention overcomes the problems of joining large areas of dissimilar metals having large differences in hardness by confining the joints to regions of relatively small size, as defined by the discs 26–30. In the electrodes disclosed in this disclosure, it is only necessary to join at intervals from mechanical and current distribution considerations.

An electrolyser constructed according to the present invention can provide the operational features of elevated and reduced pressure operation (±0.8 bar G), operation at high current density and reduced pressure efficiency (up to 4000 $A/m^2$), low anode coating wear rate, and low energy consumption. The electrolyser will operate using concentrated hydrochloric acid. Modular design is also contemplated in this invention.

The described electrolyser further has advantages of an anodic element 22 of titanium coated to protect exposed titanium from corrosion by hydrochloric acid, an aluminum current distribution plate 24 to act as a hydrogen barrier between the cathodic and anodic sides of the bipolar electrodes, and a mixed metal oxide electrocatalytic coating of high efficiency and long life for chlorine production from hydrochloric acid.

EXAMPLE 1

A cell stack was constructed according to the present invention using three bipolar electrodes 10 of the type described. An electrolyte of 22% hydrochloric acid was pumped through the electrode stack and current passed to produce chlorine and hydrogen. Over a period of time, the concentration of hydrochloric acid diminished as chloride ions were depleted. At a temperature of 40° C. and current density of 3000 $A/m^2$, the cell potential was 2.1 volts and current efficiency was in excess of 90%. Over a period of several months, the electrode coating remained intact exhibiting little or no depletion of the electroactive species.

Although the present invention has been discussed in considerable detail with reference to certain preferred embodiments, other embodiments are possible. Therefore, the scope of the appended claims should not be limited to the description of preferred embodiments contained in this disclosure.

I claim:

1. A bipolar metal electrode for the electrolysis of hydrochloric acid, comprising a nickel alloy cathode plate and a titanium anode mesh coupled together by a hydrogen barrier;

where the hydrogen barrier is an aluminum plate;

where the titanium anode mesh is connected to a titanium backplate by a plurality of titanium supports; and where the titanium backplate is spaced apart from the nickel alloy cathode plate by the aluminum plate.

2. A bipolar metal electrode according to claim 1, where the titanium backplate and the nickel alloy cathode plate are mechanically and electrically coupled by a first plurality of aluminum elements, each of the first aluminum elements having a first end which abuts the titanium backplate and a second end forming a joint to nickel alloy elements mechanically coupled to the nickel alloy cathode plate; and by a second plurality of aluminum elements, each of the second aluminum elements having a first end which abuts the nickel alloy cathode plate and a second end forming a joint to titanium elements mechanically coupled to the titanium backplate, where each of the first aluminum elements and each of the second aluminum elements extend through through-holes in an aluminum feeder plate between the titanium backplate and the nickel alloy cathode plate.

3. A bipolar metal electrode according to claim 2, where at least one of the joints between the first aluminum elements and the nickel alloy elements, or between the second aluminum elements and the titanium elements is formed by ultrasonic bonding.

4. A bipolar metal electrode according to claim 2, where all of the joints between the first aluminum elements and the nickel alloy elements, and between the second aluminum elements and the titanium elements are formed by ultrasonic bonding.

5. A bipolar metal electrode according to claim 2, where the first aluminum elements and the second aluminum elements are laminar discs, where the nickel alloy elements and the titanium elements are substantially button snapped having shoulder portions, and where the aluminum plate comprises annuler portions which are located and held between the shoulder portions and the titanium backplate and nickel alloy cathode plate.

6. A bipolar electrode according to claim 2, where the mechanical couplings comprise welds.

7. An electrolyser comprising one or more bipolar electrodes according to claim 1, where the one or more bipolar electrodes are disposed between an anode electrode and an cathode electrode.

8. An electrolyser according to claim 7, where the cathode electrode comprises a nickel alloy sheet and an aluminum sheet, with a plurality of aluminum elements extending through through-holes in the aluminum sheet and being bonded at their one sides to nickel alloy elements which are mechanically coupled to the nickel alloy sheet.

9. An electrolyser according to claim 7, where the anode electrode comprises an aluminum sheet and a titanium backplate attached to a titanium mesh by aluminum spacers; and where a plurality of aluminum elements extend through through-holes in the aluminum sheet and are bonded to titanium elements which are mechanically coupled to the titanium backplate.

10. An electrolyser according to claim 7, where the titanium anode mesh has exposed surfaces which are covered with a hydrochloric acid resistant coating.

11. An electrolyser according to claim 10, where the coating comprises a mixture of iridium and tantalum oxides in molar ratio mixtures from about 5:95 to about 95:5.

12. An electrolyser according to claim 7, where the titanium anode mesh is coated with a metal oxide electrocatalytic coating for producing chlorine from hydrochloric acid.

13. An electrolyser according to claim 12, where the electrocatalytic coating comprises a mixture of iridium, ruthenium, and titanium oxides in a ratio of about 15:15:70 w/w.

14. A method of producing chlorine from hydrochloric acid comprising providing the electrolyser according to claim 7, and contacting the electrolyser with hydrochloric acid.

15. A method of producing chlorine from hydrochloric acid comprising providing one or more bipolar metal electrodes according to claim 1, and contacting the one or more bipolar electrodes with hydrochloric acid.

* * * * *